United States Patent [19]

Matthews et al.

[11] Patent Number: 4,821,522

[45] Date of Patent: Apr. 18, 1989

[54] SEALING AND COOLING ARRANGEMENT FOR COMBUSTOR VANE INTERFACE

[75] Inventors: John A. Matthews, Melrose; Melvin H. Zeisser, Marlborough; Robert E. Coburn, Mansfield Center, all of Conn.

[73] Assignee: United Technologies Corporation, Hartford, Conn.

[21] Appl. No.: 68,870

[22] Filed: Jul. 2, 1987

[51] Int. Cl.[4] ..... F02C 1/00

[52] U.S. Cl. ..... 60/757; 60/39.83; 415/175

[58] Field of Search ..... 60/755, 757, 39.31, 60/39.32, 39.75, 39.83; 415/111, 115, 175, 176, 177

[56] References Cited

U.S. PATENT DOCUMENTS

| | | | |
|---|---|---|---|
| 3,186,168 | 6/1965 | Ormerod et al. | 60/39.32 |
| 3,307,354 | 3/1967 | Macaulay et al. | 60/757 |
| 3,527,053 | 9/1970 | Horn | 60/39.75 |
| 3,565,545 | 2/1971 | Bobo et al. | 415/175 |
| 3,670,497 | 6/1972 | Sheldon | 415/115 |
| 3,965,066 | 6/1976 | Sherman et al. | 60/757 |
| 4,025,226 | 5/1977 | Hovan | 60/757 |

*Primary Examiner*—Louis J. Casaregola
*Assistant Examiner*—Timothy S. Thorpe
*Attorney, Agent, or Firm*—Stephen E. Revis

[57] ABSTRACT

A seal assembly secured to the downstream end of a gas turbine engine combustor liner forms a gas path seal at the upstream facing platforms of turbine inlet guide vanes and also cools the vane platforms. The seal assembly includes an annular coolant compartment which feeds cooling air to a plurality of circumferentially spaced apart, axially extending open-ended channels formed between a conical portion of the downstream-most combustor liner and an annular baffle member disposed on the non-gas path side of the conical liner. The seal assembly is supported and axially located on a cylindrical surface which permits locating the seal assembly such that the downstream end of the conical liner is closely spaced from the turbine inlet guide vane platforms to reduce leakage from the gas path. The open-ended channels are also closely spaced from the vane platforms and located to direct high velocity coolant fluid against the upstream facing surfaces of the platforms at circumferential locations where the pressure in the gas path is highest, thereby further reducing leakage from the gas path.

6 Claims, 3 Drawing Sheets

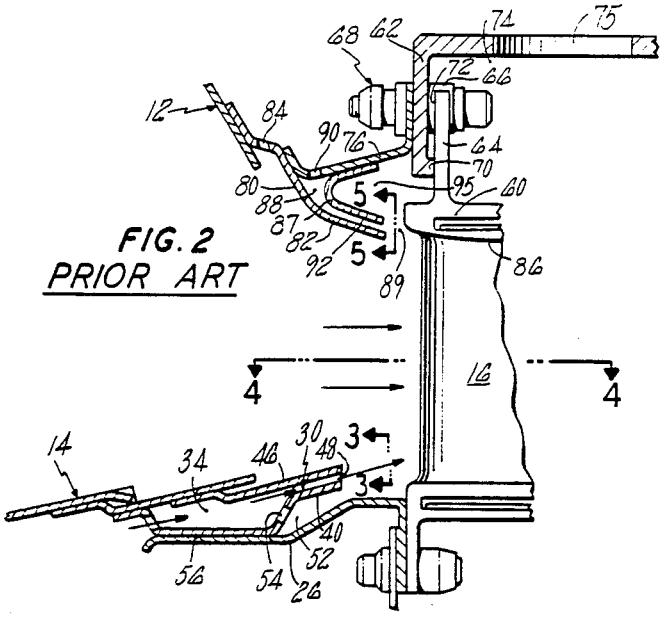
FIG. 2
PRIOR ART
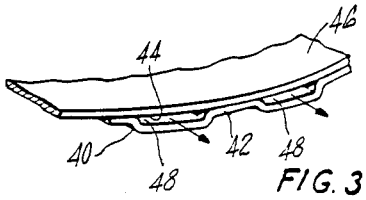
FIG. 3
PRIOR ART
FIG. 4
PRIOR ART
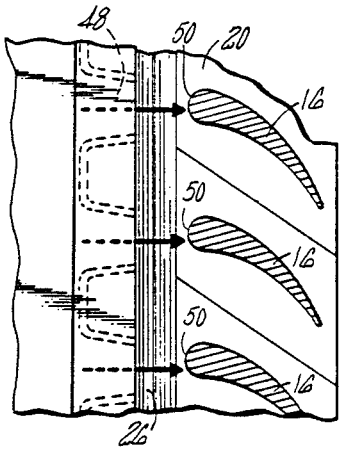
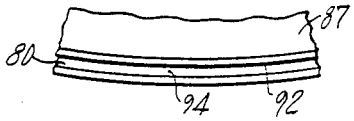
FIG. 5
PRIOR ART FIG. 6
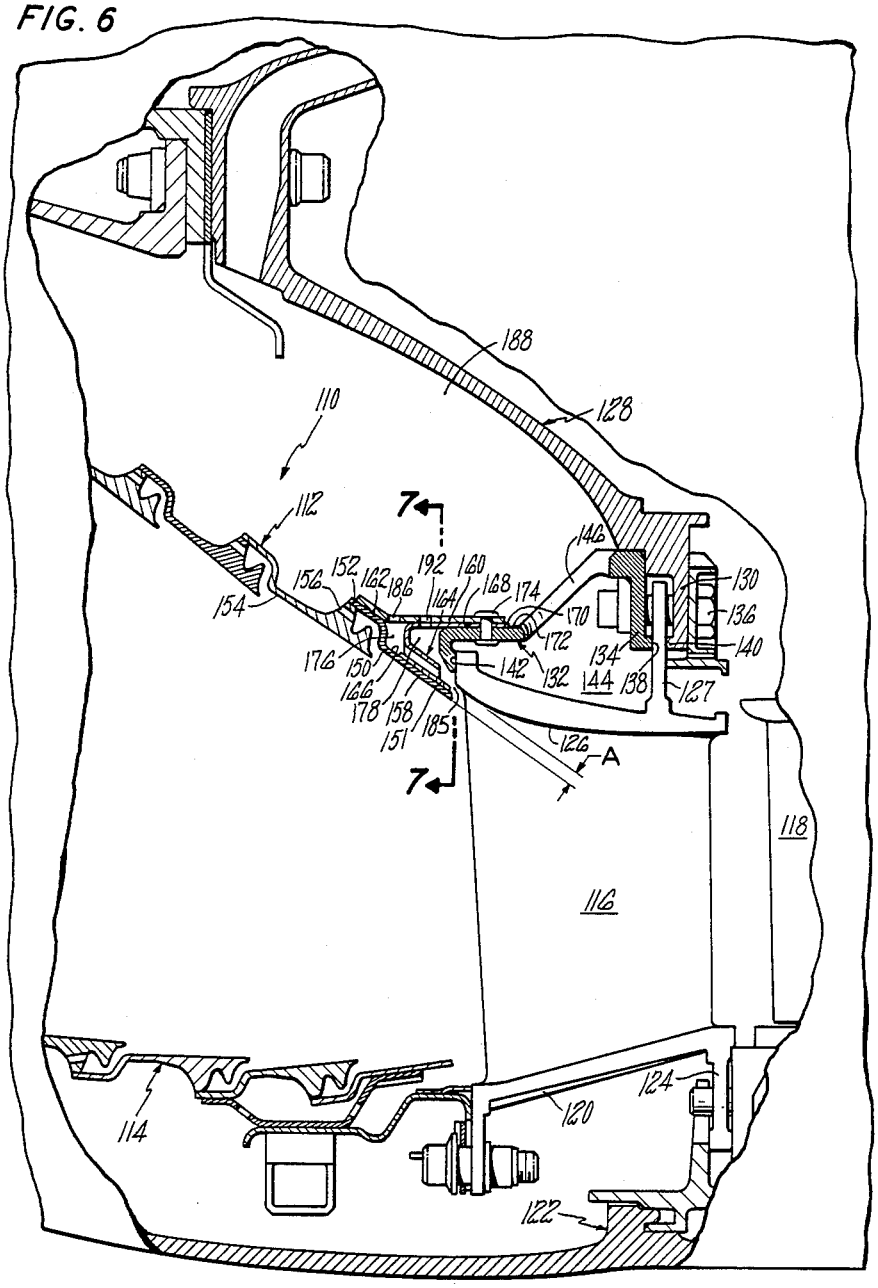
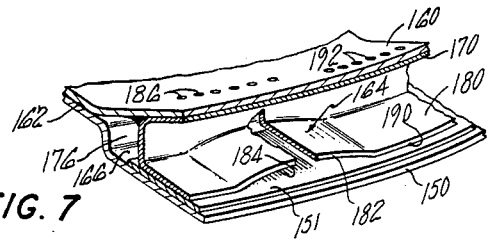
FIG. 7

SEALING AND COOLING ARRANGEMENT FOR COMBUSTOR VANE INTERFACE

DESCRIPTION

1. Technical Field

This invention relates to combustor and turbine vane assemblies in gas turbine engines.

2. Background Art

In certain gas turbine engines the turbine inlet guide vanes immediately downstream of the combustor outlet generate a pressure disturbance immediately upstream thereof which tends to deflect the hot gases and create non-uniform temperatures of the metal parts, such as at the leading edges of the vane platforms. More specifically, a circumferentially extending sinusoidal-like pressure distribution exists in a plane immediately upstream and adjacent the leading edges of the inlet guide vanes, with the highest pressures being substantially aligned with the leading edges of the vanes and the lowest pressures being between vanes.

As is true in all engines, to maximize performance it is necessary to minimize leakage from the gas path. Since all gaps in the flow path wall cannot be completely eliminated, it is known to use compartments behind such gaps which are fed coolant fluid at a pressure higher than the gas path fluid pressure such that flow through the gap is mostly into rather than out of the gas path.

The prior art is shown in FIGS. 1 thru 5, which are illustrative of a model of the JT9D engine manufactured by Pratt & Whitney of United Technologies Corporation, the assignee of the present application. Similar prior art is also shown and described in commonly owned U.S. Patent application Ser. No. 659,748, entitled Cooling Scheme for Combustor Vane Interface by Pettengill et al. filed Oct. 11, 1984. The engine combustor is generally represented by the reference numeral 10 and comprises an inner annular louvered liner 12 and an outer annular louvered liner 14. A stage of circumferentially spaced apart turbine inlet guide vanes 16 directs the hot combustion gases onto and through a stage of turbine blades 18. Radially outer vane platforms 20 are rigidly secured to and supported from outer casing 22 through rear flanges 24 which are bolted to the engine casing 22. An annular sheet metal outer combustor liner support member 26 is securedly bolted to front flange members 28 of the outer platforms 20.

The outer combustor liner 14 includes an annular baffle member 30 secured to its downstream end. The baffle member 30 is slidably disposed within an inner cylindrical surface of the upstream end 32 of the support member 26. The baffle member 30 defines an annular coolant chamber 34 with the liner 14 which is fed compressor discharge air from a cavity 36 through passages 38. As best seen in prior art FIG. 3, the downstream end 40 of the baffle member 30 has a circumferentially extending wave shape. Alternate flat peaks 42 of the wave mate with the conical outer surface 44 of the downstream-most louver member 46 of the liner 14 and are affixed thereto such as by welding. Open-ended channels 48 are thereby formed and direct coolant fluid from the compartment 34 toward the inlet guide vanes 16. One channel 48 is substantially aligned with the leading edge 50 of each vane 16. Since the outlets of the channels 48 are substantially rectangular, the flow rate of coolant therefrom is substantially uniform across the circumferential width of each outlet.

In an effort to minimize the backflow of hot gases into the annular pocket 52 formed between the support member 26 and the baffle member 30, some of the coolant fluid entering the compartment 34 is directed into the pocket 52 through a plurality of circumferentially spaced apart passages 54 through the baffle member; however, because the outlet area of the pocket 52 cannot be closely controlled due to differential thermal growth and parts tolerances, it has not been possible to maintain a pressure in the pocket 52 which is in all regions around the outlet circumference greater than the gas path pressure.

Although not shown in the drawing, the combustor liner 14 is substantially fixed at its upstream end. Differential thermal growth and manufacturing tolerance build up is accommodated at the cylindrical interface 56 near the liner's downstream end where sliding between the mating parts may occur. Since the sinusoidal-like pressure gradient created by the vanes 16 is immediately upstream of and adjacent the plane of the leading edges 50, it is most desirable that the outlets 48 be as close as possible to the leading edges. In this prior art construction the location of the outlets 48 must be set at some nominal, relatively large distance from the leading edges to assure that no contact between parts can occur throughout the engine operating envelope.

Turning now to the radially inner cooling and sealing construction of the prior art JT9D engine, the inner platforms 60 are arcuate segments which are connected to an annular support member 62 through radially inwardly extending flanges 64 which have U-shaped cutouts (not shown) at their radially innermost end. The cutouts fit around cylindrical guide surfaces 66 which are a part of bolt assemblies 68, only one of which is shown. An annular rib 70 integral with the member 62 bears against the forward facing surface 72 of the flange 64 during operation to minimize the amount of leakage of coolant fluid from the coolant compartment 74. The compartment 74 receives coolant fluid through openings 75 in the member 62, which fluid is ultimately passed through the hollow vanes 16.

The inner louver liner 12 is connected to the structural vane support member 62 through an annular sheet metal member 76 by the bolt assembly 68. The downstream most louver liner member 80 receives a film of coolant fluid over its inner conical surface 82 through a plurality of holes 84. A further means for cooling the surface 82 is the use of an annular baffle member 87 which is secured to the member 76 to define a compartment 88 into which coolant fluid is introduced through a plurality of passages 90 through the member 76. The baffle member 87 includes a conical downstream end portion 92 spaced from the conical end portion of the liner 80 to define a full annular channel 94 (FIG. 5) through which the coolant flows. This fluid combines with fluid on the surface 82 from the holes 84 and is directed adjacent the gas path surface 86 defined by the platforms 60 for the purpose of cooling the platforms. This flow of coolant also acts as a barrier to reduce the flow of hot gases from the gas stream into the coolant compartment 95. It is important that the film coolant flow from the surface 82 and channel 94 be directed at the proper radial location relative to the platform surface 86 to prevent separation of flow and rapid mixing of hot combustor gas with these cooler film layer gases.

In this prior art construction the radial location of the surface 82 relative to the gas path surface 86, as well as the size of the gap 89 between the platforms 60 and the liner 80, is determined by the combination of several factors. One factor is the thermal growth of the aft portion of the platform 60. Because the vanes 60 are tied to the outer casing 22, the platforms (which are arcuate segments) move radially inwardly as the vanes are heated. On the other hand the liner 80, which is a full annular ring, grows radially outwardly. This differential thermal growth cannot be accurately controlled due to the backpressuring effect from the leading edge of each vane 16 on the cooling flow. The sinusoidal-like backpressure effect causes the cooling flow to be deflected locally in a circumferential direction and displaced by hot combustion gases. As a consequence, the liner 80 is heated unevenly and unpredictably.

Another factor in controlling the size of the gap 89 is that the initial radial location of the conical downstream, portion of the liner 80 is determined by the shape and size of the manufactured parts. Since these parts are conical (including the support member 76) there is considerable variation in the final radial location of the aft end of the liner 80, and there is no ability to make adjustments at assembly.

In the prior art construction all of the foregoing factors contributed to the necessity of tolerating a gap 89 as large as one-quarter ($\frac{1}{4}$) inch in Pratt & Whitney's JT9D engine.

DISCLOSURE OF INVENTION

One object of the present invention is an improved gas path seal and cooling arrangement for a stage of turbine inlet guide vanes in a gas turbine engine.

According to the present invention, a seal assembly secured to the downstream end of a gas turbine engine combustor liner includes an annular coolant compartment which feeds cooling air to a plurality of circumferentially spaced apart, axially extending open-ended channels formed between a conical portion of the downstream-most combustor liner and an annular baffle member disposed on the non-gas path side of the conical liter, wherein the seal assembly is supported and axially located in a cylindrical surface which permits locating the seal assembly such that the downstream end of the conical liner is closely spaced from the turbine inlet guide vane platforms to reduce leakage from the gas path, and wherein the open-ended channels are also closely spaced from the vane platforms and located to direct high velocity coolant fluid against the upstream facing surfaces of the platforms at circumferential locations where the pressure in the gas path is highest, thereby further reducing leakage from the gas path.

The cylindrical locating surface for the seal assembly allows the seal assembly to be positioned axially until the conical gas path facing surface of the downstream-most liner is located to direct a film of cooling fluid therefrom at the proper radial location adjacent the gas path facing the surfaces of the vane platforms. The liner is initially fabricated with extra length and, once its proper axial position is determined, is cut back to a point where only a small annular gap exists between the liner downstream edge and the upstream face of the vane platforms.

In a preferred embodiment a second annular coolant compartment is formed immediately downstream of the first annular coolant compartment; and coolant fluid is directed into that compartment to pressurize it and thereby provide positive outflow into the hot gas path. Such pressurization is possible because the present invention permits the maintenance of a small annular gap at the compartment outlet.

According to another preferred aspect of the present invention, each open-ended channel is shaped to direct a greater flow of coolant fluid from its central portion than from its circumferentially spaced apart sides to distribute the coolant fluid circumferentially at a mass flow rate more closely proportional to the circumferential pressure distribution within the gas path.

The foregoing and other objects, features and advantages of the present invention will become more apparent in the light of the following detailed description of preferred embodiments thereof as illustrated in the accompanying drawing.

BRIEF DESCRIPTION OF THE DRAWING

FIG. 2 is an enlarged view of the combustor/turbine inlet guide vane area shown in FIG. 1.

FIG. 3 is a cross-sectional view taken along the line 3—3 of FIG. 2.

FIG. 4 is a cross-sectional view taken along the line 4—4 of FIG. 2.

FIG. 5 is an oblique view taken generally in the direction 5—5 of FIG. 2.

FIG. 6 shows the same area of a gas turbine engine as shown in FIG. 2 incorporating the improved sealing and cooling arrangement of the present invention.

FIG. 7 is a sectional view taken along the line 7—7 of FIG. 6.

BEST MODE OF CARRYING OUT THE INVENTION

Figure 1:
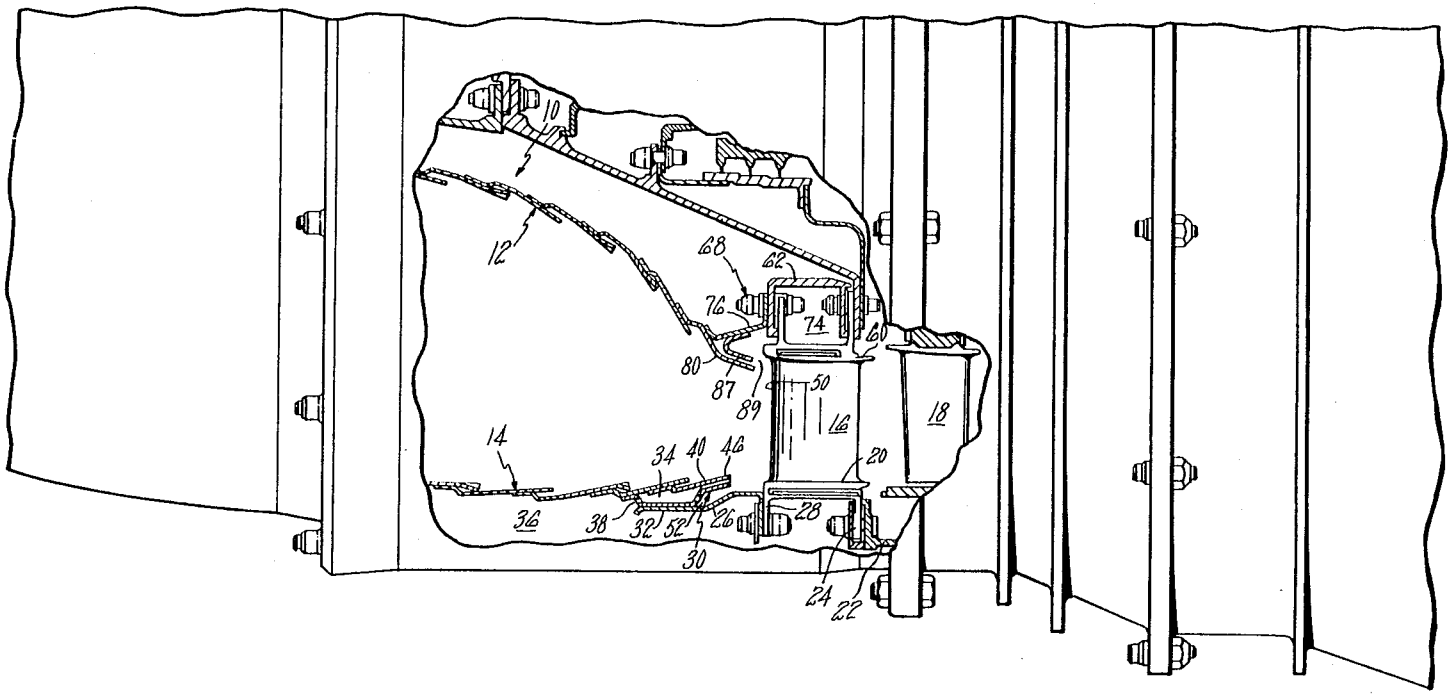
FIG. 1 PRIOR ART
FIG. 1 is a partial view of a gas turbine engine, partly in section, showing a sealing and cooling arrangement of the prior art.

The embodiment of FIG. 6 depicts the present invention as used in the PW4000 engine manufactured by the Pratt & Whitney Division of United Technologies Corporation the assignee of the present invention. The engine combustor is generally represented by the reference numeral 110 and comprises an inner annular louvered liner 112 and an outer annular louvered liner 114. Only the downstram portion of the combustor 110 is shown. A stage of circumferentially spaced apart turbine inlet guide vanes 116 directs the hot combustion gases into and through a stage of turbine blades 118. Vanes 116 are secured to and supported from inner support structure 128 through rear flanges 127 integral with the platforms 126, which are arcuate segments. Inner support structure 128 includes an annular flange 130 disposed on the downstream side of the platform flanges 127. An annular vane support structural member 132 includes a radially outwardly extending flange 134 adjacent the upstream facing side of the flange 127. Bolts 136 pass through holes in the flanges 127, and urge the flanges 134, 130 together thereby trapping the flanges 127 between axially extending annular lips 138, 140. The lips 138, 140 sealingly engage opposite sides of the flanges 127. The platforms 126 cannot move axially or radially relative to the structure 128, but some axial tilting can be accommodated.

The vanes 116 are connected to the outer engine casing 122 through flanges 124 integral with the outer platforms 120 in a manner which permits relative radial movement between the flanges 124 and casing 122. Support for the downstream end of the outer annular combustor liner 114 and the arrangement for providing a flow of coolant to the leading edges of the vanes 116 near their outer platforms 120 is essentially the same as that described with respect to the JT9D engine of the prior art, and is therefore not further described herein.

The upstream end of the structural member 132 sealingly engages the upstream faces 142 of the platforms 126 and forms an annular coolant compartment 144 radially inwardly of the platforms. Coolant fluid enters the compartment 144 through a plurality of large openings 146 through the member 132. That fluid thereupon passes into the hollow vanes 116 for cooling the same.

The inner louvered liner 112 is radially supported at its upstream end (not shown) and can slide axially at its upstream end to accommodate thermal growth and manufacturing tolerances. The liner 112 includes a downstream-most sheet metal liner member 150 which is welded at 152 to the adjacent liner member 154. Coolant air enters passages 156 through the liner member 154 and flows downstream as a coolant film over the inwardly facing conical gas path surface 158 of the liner member 150. The liner 112 is connected to and supported by the structural member 132 through an annular sheet metal wall member 160 which is welded at 162 near its upstream end to the upstream end of the liner member 150. A baffle member 164 is disposed within the cavity formed between the inner conical surface 166 of the liner member 150 and the cylindrical surface 168 of the member 160. An inner cylindrical leg 170 of the baffle member 164 is sandwiched between the cylindrical surface 168 and a radially inwardly facing cylindrical surface 172 at the upstream end of the structural member 132. Rivets 174 or other suitable means fixedly secure the seal assembly to the structural member 132. A frustoconical strengthening member 151 is welded to the inner conical surface 166 of the liner member 150, and is herein considered a part of the liner member.

The baffle member 164 divides the annular space between the member 160 and the liner 150 into forward and rearward annular compartments 176, 178, respectively. As best seen in FIG. 7, a radially outer end of the baffle member 164 has a circumferentially extending wave shape comprising relatively flat frustoconical portions 180 alternating with radially inwardly bowed arcuate portions 182. The bowed portions 182 define a plurality of circumferentially spaced apart open-ended channel 184. Coolant fluid entering the forward compartment 176 through groups of circumferentially spaced apart holes 186 in the support member 160 passes through the channels 184 and is directed against the upstream faces 142 of the platforms 126. Each group of holes 186 is substantially circumferentially aligned with a corresponding channel 184.

Due to the sinusoidal-like pressure distribution within the gas path immediately upstream of the leading edges of the vanes 116, the channels 184 are disposed circumferentially such that the coolant flow therefrom is circumferentially aligned or in register with the highest pressure regions of that pressure distribution. Thus, there is one channel 184 axially aligned with each vane 116 for directing a flow of coolant at high velocity across the annular gap 185 between the vane platforms 126 and the liner member 150. The arcuate configuration of the wall portion 182 further maximizes the benefits of the present invention by providing a non-uniform circumferential flow distribution from each channel with the greatest flow rate emerging from the center of the channel and tapering off to no flow on either side thereof at the circumferentially spaced apart sides of the channel. The centers of each channel are circumferentially aligned with the high pressure peaks of the sinusoidal-like pressure distribution, which peaks are substantially axially aligned with the leading edge of each vane.

Circumferentially spaced apart holes 186 through the support member 160 are sized such that the pressure drop between the internal compartment 188 and the forward compartment 176 is only about half the pressure drop from the internal compartment 188 to the outlets of the open-ended channels 184. The remainder of the pressure drop is taken across the open-ended channels 184. Differential thermal growth tends to separate the mating interfaces 190 between the strengthener 151 and the frustoconical portions 180 of the baffle member 164, which are not secured to each other. As that gap increases the pressure in the compartment 176 is reduced, allowing the total flow into the compartment 176 to increase. Increased flow through the open-ended channels 184 provides further cooling of the liner member 150 and strengthener 151, causing them to decrease in diameter, thereby tending to automatically reduce any gap at the interface 190. This helps maintain the high velocity of the flow from the channels 184, and keeps it concentrated at the appropriate circumferential locations. For the present construction to operate in this self-correcting manner, the sum of the cross sectional area of the holes 186 should be sized such that no more than about 70% of the pressure drop between the compartment 188 and the outlets of the open-ended channels 184 should take place across the holes 186 when there is no gap at the interface 190.

A plurality of holes 192 through the structural member 160 and the baffle member 164 are disposed circumferentially in groups aligned circumferentially between the open-ended channels 184. This flow pressurizes the compartment 178 and prevents ingestion of any hot gas through the gap 185 by producing a positive coolant flow into the gas path around the entire circumference of the gap. To be able to maintain a positive flow out of the compartment 178 around the entire circumference of the gap, the gap must be maintained as small as possible. The fact that the vanes 116 are tied to the inner structure 128 rather than to the outer casing 122 helps minimize radial thermal growth differences between the liner member 150 and the platforms 126, which reduces the maximum gap size.

An important aspect of the present invention is to have the outlets of the open-ended channels 184 as close axially to the sinusoidal-like pressure disturbance as possible such that the flow therefrom does not have a great chance to diffuse and flow around the circumferential sides of the higher pressure regions within the gas path. This also requires a small a gap 185 as possible, which further reduces hot gas flow into the compartment 178. To obtain the smallest possible gap 185 the liner member 150 is initially fabricated longer than required. Before the rivets 174 are put into place the support member 160 and liner member 150, which are welded together at 162, are slid axially along the cylindrical surface 172 to position the gas path conical surface 158 such that the dimension "A" is as desired. The support member 160 is then marked to locate rivet holes therethrough in alignment with the rivet holes in the structural member 132. Thereafter the length of the liner 150 is cut back to produce the desired gap 185 and the assembly is secured by rivets 174. The tolerances build-up of the parts of the liner 112 and its overall thermal growth are taken out at sliding support surfaces at the upstream end of the liner 112. A gap 185 having a maximum, cold dimension no greater than about 0.050 inch is preferred. A maximum gap of 0.030 inch has been attained with the construction of the present invention.

Although the invention has been shown and described with respect to a preferred embodiment thereof, it should be understood by those skilled in the art that other various changes and omissions in the form and detail of the invention may be made without departing from the spirit and scope thereof.

We claim:

1. In an axial flow gas turbine engine including a combustor, inner structural means and outer engine casing means, and a stage of circumferentially spaced apart turbine inlet guide vanes downstream of said combustor and disposed between said inner structural means and outer casing means, each of said vanes having a platform and a leading edge, an annular seal assembly connected to said platforms, said platforms including a gas path defining annular surface having an upstream end, wherein during operation a circumferentially extending sinusoidal-like pressure distribution exists in the gas path immediately upstream of said vanes with a higher pressure region substantially circumferentially aligned with each vane leading edge and lower pressure regions therebetween, the improvement comprising:

said seal assembly including an annular sheet metal liner member secured to said cumbustor and including a conical portion having downstream end and a first substantially conical gas path defining surface terminating at said downstream end, said conical surface being adapted to have a film of coolant flowing downstream thereover and being oriented and disposed at a first axial location selected to direct said coolant flow downstream adjacent and substantially parallel to said gas path surface of said platform;

said conical platform having a second substantially conical surface facing away from the gas path and terminating at said downstream end, wherein said downstream end is closedly axially spaced from said platforms to define a small annular gap therebetween;

a structural member connected to said platforms and having a conical support surface at its upstream end radially spaced from said conical portion downstream end;

said seal assembly including an annular sheet metal wall member external of the gas path, fixed axially relative to said liner member and spaced radially from said conical portion;

said seal assembly including annular baffle means disposed within the space between said conical portion and said wall member, fixed axially relative to said conical portion and wall member and having a generally conical, wave-shaped portion mating with said second conical, surface of said liner member at alternate wave peaks to form a plurality of circumferentially spaced apart open-ended axially extending channels;

said seal assembly including means defining a first annular compartment upstream of and in fluid communication with said open-ended channels, including first coolant passages through said wall member for introducing coolant air into said first cavity, said open-ended channels being the same in number as the number of vanes in said stage of vanes, each open-ended channel being aligned with a respective one of said vanes for directing coolant from said first compartment through said open-ended channels, across said gap, and at the leading edge of each vane, each of said open-ended channels being constructed to direct coolant fluid at a respective higher pressure region immediately upstream of each vane leading edge;

wherein said seal assembly includes a cylindrical surface which mates with said cylindrical surface of said support member and is fixedly secured thereto to locate said liner member conical gas path surface at said selected first axial location.

2. The improved seal assembly according to claim 1, wherein said wave-shaped portion of said baffle means includes bowed segments which define said open-ended channels to direct a greater mass flow rate of coolant through the central portion of each channel than along the circumferential sides of said channels.

3. The improved seal assembly according to claim 2, wherein said seal assembly includes a second coolant compartment downstream of said first coolant compartment, said wall member including second coolant passages therethrough to pressurize said second compartment and provide a positive coolant flow into the gas path around the entire circumference of said annular gap.

4. The improved seal assembly according to claim 1 wherein said conical portion of said baffle member is free to move radially relative to said conical portion of said liner member, and wherein said first coolant passages are sized to result in a first pressure drop thereacross when said conical portion of said baffle member is in contact with said conical portions of said liner member, and a second, larger pressure drop when thermal growth differences separate said conical portions, whereby more coolant flows into said first annular compartment and reduces the amount of separation.

5. The improved seal assembly according to claim 3, wherein said small annular gap is no greater than about 0.050 inch under cold conditions.

6. The improved seal assembly according to claim 5, wherein said vane platforms are radially inner platforms, and said inner platforms are fixed axially and radially relative to said inner structural means, and said vanes can grow radially outwardly relative to said outer casing means.

* * * * *

UNITED STATES PATENT AND TRADEMARK OFFICE

CERTIFICATE OF CORRECTION

PATENT NO. : 4,821,522

DATED : April 18, 1989

INVENTOR(S) : John A. Matthews, Melvin H. Zeisser, Robert E. Coburn

It is certified that error appears in the above-identified patent and that said Letters Patent is hereby corrected as shown below:

Column 3, line 6: after "portion" insert --of the liner 80 relative to the thermal growth"

Column 3, line 43: before "wherein" change "liter" to "liner"

Column 3, line 44: after "located" change "in" to "on"

Column 4, line 45: after "the" (first occurrence) change "downstram" to "downstream"

Column 6, line 55: after "requires" change "a" to "as"

Column 7, line 41: after "conical" change "platform" to "portion"

Column 7, line 48: after "having a" change "conical" to "cylindrical"

Signed and Sealed this

Twenty-ninth Day of May, 1990

*Attest:*

HARRY F. MANBECK, JR.

*Attesting Officer*

*Commissioner of Patents and Trademarks*